US005092295A

United States Patent [19]

Kobayashi

[11] Patent Number: 5,092,295

[45] Date of Patent: Mar. 3, 1992

[54] ANTI-AFTER-BURNING SYSTEM IN AN INTERNAL COMBUSTION ENGINE

[75] Inventor: Kazuyuki Kobayashi, Nagoya, Japan

[73] Assignee: Mitsubishi Jukogyo Kabushiki Kaisha, Tokyo, Japan

[21] Appl. No.: 662,572

[22] Filed: Mar. 1, 1991

[30] Foreign Application Priority Data

Mar. 1, 1990 [JP] Japan ..... 2-19436[U]

[51] Int. Cl.[5] ..... F02B 77/00

[52] U.S. Cl. ..... 123/198 DC; 123/DIG. 11

[58] Field of Search ..... 123/198 DC, DIG. 11, 123/376, 403

[56] References Cited

U.S. PATENT DOCUMENTS

| | | | |
|---|---|---|---|
| 2,514,673 | 7/1950 | Rider | 123/198 DC |
| 2,935,977 | 5/1960 | Eberline | 123/198 DC |
| 3,276,439 | 10/1966 | Reichenbach | 123/376 |
| 4,517,942 | 5/1985 | Pirkey et al. | 123/376 |

FOREIGN PATENT DOCUMENTS

| | | |
|---|---|---|
| 0348706 | 1/1990 | European Pat. Off. . |
| 61-250350 | 11/1986 | Japan . |

*Primary Examiner*—Noah P. Kamen

*Attorney, Agent, or Firm*—Wenderoth, Lind & Ponack

[57] ABSTRACT

An anti-after-burning system in an internal combustion engine provided with a governor device, in which a governor spring is stretched between a governor lever and a governor control lever and the governor lever is connected to a carburetor throttle lever, and a stoppage device for stopping an engine by grounding a primary wire of an ignition circuit, is improved. The governor control lever is provided with a grounding section for grounding the primary wire of the ignition circuit as a result of the rotation of the lever to an engine stoppage position. The governor lever and one end of the governor spring are connected so as to be relatively rotatable and so as to have a freedom of movement with respect to the axial direction of the governor spring. Furthermore, the governor spring is constructed in such manner that when the governor control lever is at the stoppage position for grounding the primary wire of the ignition circuit, a coiled portion of the governor spring butts against the governor lever to constrain rotation of the governor lever in the direction which would cause the carburetor throttle valve to open.

4 Claims, 7 Drawing Sheets

ANTI-AFTER-BURNING SYSTEM IN AN INTERNAL COMBUSTION ENGINE

BACKGROUND OF THE INVENTION

1. Field of the Invention

The present invention relates to an anti-after-burning system applicable to an industrial engine provided with a governor device.

2. Description of the Prior Art

An engine stopping and controlling system disclosed in Japanese Utility Model Publication No. 1-28282 (1989) will be explained with reference to FIGS. 9 to 13 as one example of an anti-after-burning system in the prior art. FIG. 9 is a front view of an engine directly coupled to a rotary machine. FIG. 10 is a front view of an anti-after-burning system. FIG. 11 is a schematic plan view of the system showing the state where a throttle is set on a high-speed side. FIG. 12 is a schematic plan view of the system showing the state where a throttle is held on a low-speed side as a result of the excitation of a solenoid when no load is on the engine. And, FIG. 13 is a schematic plan view of the system showing the state of a plunger once the engine has been stopped, a stop button has been press-actuated, and the plunger has been retracted while having moved a throttle to a low-speed side.

In these figures, reference numeral 11 designates the engine, numeral 12 designates the rotary machine such as an electric generator, a welding machine or the like which is directly coupled to the engine, numeral 13 designates an air cleaner, numeral 14 designates a carburetor, and numeral 15 designates a governor mechanism. The governor mechanism includes a governor spring 19 stretched between a governor control lever 18 and a governor lever 17 pivotably supported by a governor shaft 16. One end of this governor lever 17 and a throttle lever 20 of the carburetor 14 are connected by means of a governor rod 22 wound by a rod spring 21. In this illustrated engine, the resilient force exerted by the governor spring 19, generated owing to the rotational position of the above-mentioned governor control lever 18, biases the governor lever 17 to a high-speed side. Consequently, the throttle lever 20 is normally set at the high-speed side. In addition, reference numeral 23 designates a solenoid powered by an engine charging coil (in the case where the rotary machine driven by the engine is an electric generator, the solenoid could be powered by the electric generator). The solenoid 23 is provided with a plunger 24 that is free to move except when the solenoid is excited. This plunger 24 is connected to the governor lever 17 directly or via a rod 25. When the engine 11 is not loaded, the plunger 24 is retracted under the excitation of solenoid 23 and the governor lever 17 and the throttle lever 20 having been set at the high-speed side are moved to the low-speed side. It is to be noted that while the plunger 24 is free to move when the solenoid is not excited in the illustrated engine, an internally contained spring could be provided in the solenoid 23 to normally bias the plunger 24 forwards.

The above-described engine is provided with a stoppage switch 26 for stopping the engine. This stoppage switch 26 has a contact connected via a cable to a primary wire of an ignition circuit and a ground side contact provided within a main body 27. A contact piece is provided on a bottom surface of a switch actuator 28 which extends through an aperture in the main body 27. Thus, the switch 26 is adapted to be turned on or off by the contact or separation of this contact piece with or from the above-mentioned contacts. The switch actuator 28 is biased in a direction of separation by means of a return spring 29 contained within the main body 27. In addition, the actuator 28 of the above-mentioned switch 26 has a holding rod 30 projecting from the bottom surface of the main body 27. The holding rod 30 is projected and retracted through the bottom surface of the main body 27 when the main body is slid in an approaching direction upon the press-actuation of the actuator 28 and is slid in the separating direction under the biasing force exerted by the return spring 29, respectively. This stoppage switch 26 is mounted by bracket 31 in the proximity of the outer circumference of the plunger 24 of the solenoid 23 when the plunger is in its extended state. A holding groove 32 for receiving the holding rod 30 is formed circumferentially or in a spotted pattern on the outer circumference of the plunger 24. The groove 32 becomes opposed to the tip end of the holding rod 30 of the above-mentioned switch actuator 28 when the plunger 24 has been attracted under the excitation of the solenoid 23 upon no loading of the engine. When the engine stops (upon no loading), the holding rod 30 is engageably inserted into the holding groove 32 of the plunger 24, and while the switch actuator 28 is being press-actuated, the retracted state of the plunger 24 can be maintained against the resilient force of the governor spring 19 even if the solenoid 23 is demagnetized.

Upon loading of the engine 11, as shown in FIG. 11, the solenoid 23 is in a demagnetized condition, so that the governor lever 17 is swung by the governor control lever 18 and the governor spring 19 so as to set the throttle lever 20 to the high-speed side. On the other hand, upon no loading of the engine 11, as shown in FIG. 12, the solenoid 23 is excited through an electric wiring (not shown) and retracts the plunger 24 against the resilient force of the governor spring 19 which was set on the aforementioned high-speed side, whereby the governor lever 17 and the throttle lever 20 are moved to the low-speed side. Upon stoppage of the engine, after the above-described no load condition shown in FIG. 12 has been established, the switch actuator 28 is pressed against the force exerted by the return spring 29, and as a result of its contact piece coming into contact with the respective contacts of the ignition circuit primary wire and the ground side, the ignition circuit primary wire is grounded. At this time the solenoid 23 having retracted and the plunger 24 had been demagnetized. However, due to the pressed state of the switch actuator 28, the holding rod 30 projects into the holding groove 32 on the outer circumference of the plunger 24 as shown in FIG. 13. Therefore, while the switch actuator 28 is kept in the pressed condition, the plunger 24, the governor lever 17 and the throttle lever 20 can be maintained on the low-speed side against the resilient force of the governor spring 19. Accordingly, the above-described arrangement can preclude the disadvantage that occurs upon the stoppage of an engine, when the output of the engine 11 gradually decreases and the solenoid 23 which has retracted the plunger 24 to the low-speed side against the biasing force of the governor spring 19 is demagnetized. That is, in spite of additional rotational output by the engine (ignition plugs are not sparking) unnecessary fuel will not be sucked in great quantities because the governor lever 17 and the throttle lever 20 have not returned to the high-speed side.

However, the above-described anti-after-burning system in the prior art involves the following problems. That is, due to the fact that a solenoid is utilized in order to prevent an excessive suctioning of fuel after the feeding of electric energy to the engine has been terminated, an electric energy source for exciting the solenoid is necessary. Accordingly, the above-described system is applicable only to an engine provided with a battery or an engine-driven type electric generator, and it cannot be applied to an engine not having an electric energy source.

SUMMARY OF THE INVENTION

It is therefore one object of the present invention to provide an improved anti-after-burning system in an internal combustion engine, which can prevent after-burning caused by inhibiting an excessive suction of fuel, and which is operable in an engine not provided with an electric energy source, that is, in an engine not equipped with a battery or an engine other than an engine-driven electric generator.

According to one feature of the present invention, there is provided improvements in an anti-after-burning system of an internal combustion engine provided with a governor device, in which a governor spring extends between a governor lever and a governor control lever and the governor lever is connected to a carburetor throttle lever, and a stoppage device for stopping the engine by grounding a primary wire of an ignition circuit thereof. The improvements reside in that the governor control lever is provided with a grounding section for grounding the primary wire of the ignition circuit as a result of the rotation of the control lever to an engine stoppage position, in that the governor lever and one end of the governor lever are connected so as to be relatively rotatable and so as to have freedom of movement with respect to the axial direction of the governor spring, and further in that when the governor control lever is at the position in which the primary wire of the ignition circuit is grounded, a coiled portion of the governor spring will butt against the governor lever to constrain rotation of the governor lever in a direction which would open the carburetor throttle valve.

In other words, in order to achieve the aforementioned object, the governor control lever grounds the primary wire of the ignition circuit at the engine low-speed side position, that is, after being rotated in a direction decreasing the resilient force of the governor spring. The engagement between the governor lever and the governor spring allows relative rotation and constrains movement only in a direction which would increase the resilient force exerted by the governor spring. By making the interval between the engagement section of the governor lever and the coiled portion of the governor spring smaller than the stroke of the control lever between its engine low-speed and engine stoppage positions, at the engine stoppage position, the force necessary to buckle the governor spring is larger than a compression force exerted on the governor spring by the governor lever, so that the carburetor throttle will not open.

According to the present invention, owing to the above-described structural features, the following advantages are obtained. When an ignition plug does not spark after the grounding of the primary wire, although the governor lever generates a force tending to open the carburetor throttle valve as a result of the decrease in the rotational output speed of the engine, since the governor lever and the governor spring are constrained in the aforementioned axial direction (in the direction of contraction of the governor spring), the governor lever cannot move and the carburetor throttle valve is held nearly completely closed. Consequently, the inertial rotation of the engine, while the ignition plug is not sparking, will only suction a minimum amount of unburnt fuel-air mixture gas into the engine itself. Because the amount of fuel in the suctioned amount of the unburnt fuel-air mixture gas is so little, the suction of this unnecessary fuel cannot be considered excessive. In fact, serious after-burning cannot be caused by that fuel.

The above-mentioned and other objects, features and advantages of the present invention will become more apparent by referring to the following description of one preferred embodiment of the present invention taken in conjunction with the accompanying drawings.

DETAILED DESCRIPTION OF THE PREFERRED EMBODIMENT

Now, one preferred embodiment of the present invention will be described with reference to FIGS. 1 to 8.

Figure 1:
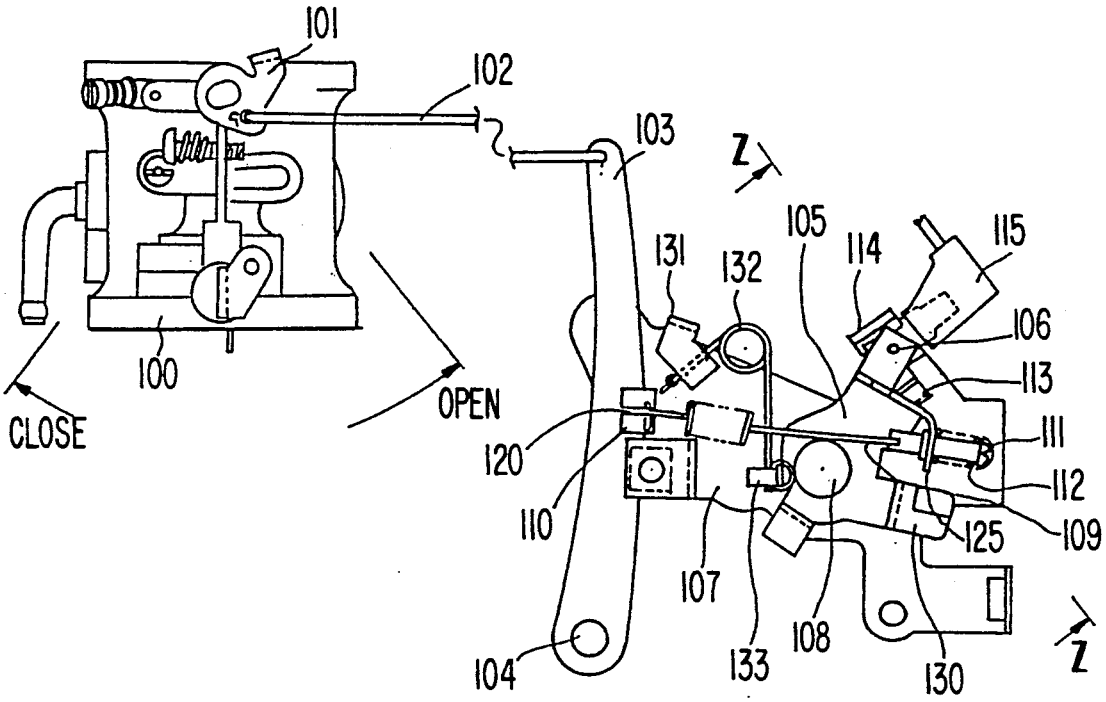
FIG. 1 is a general side view of one preferred embodiment of the present invention.
Figure 2:
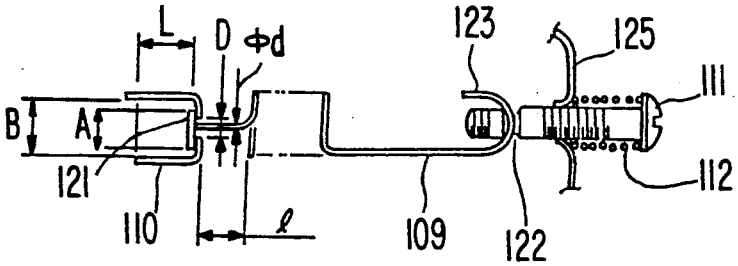
FIG. 2 is a plan view of a governor lever engaging section and a governor spring portion.

In FIGS. 1 and 2, reference numeral 100 designates a carburetor, which is provided with a throttle valve (not shown) for adjusting a feed rate of fuel to a combustion chamber. The opening and closing of the throttle valve is controlled by the rotation of a throttle lever 101. A governor rod 102 is engaged with one end of the throttle lever 101, and the other end of the governor rod 102 is engaged with a governor lever 103. The governor lever 103 is fixedly secured to a governor shaft 104. According to a rotational speed of a governor gear (not shown), the governor shaft will rotate in the clockwise direction when a rotational output of the engine falls below a certain speed but will rotate in the counterclockwise direction when the rotational output of the engine is above a certain speed.

The governor lever 103 is provided with an engagement section 110 having such a shape that a governor spring 109 connected thereto is free to move only in the axial direction thereof. The engagement section 110 defines a slit D larger than a wire diameter d of the governor spring 109. One end of the governor spring 121 is shaped such that it may engage the engagement section 110 but such that it will not be constrained in the torsional direction of the spring.

On the other hand, the other end of the governor spring 109 is engaged with an adjusting screw 111 set based on the highest speed of the rotational output of the engine. The screw 111 is rotatably mounted to a screw mount section 125 provided at one end of a control lever 105. When the control lever 105 is rotated, the governor spring 109 will thus be extended or contracted by a corresponding amount.

The control lever 105 is provided with a hole 106 for receiving a control cable (not shown), a grounding section 130 for an ignition circuit primary wire of the engine, and an engagement section 133 receiving a return spring 132. The return spring 132 biases the control lever 105 toward a stoppage position at which the lever 105 will stop the engine. The control lever 105 is rotatably mounted to a control panel 107 by means of a caulking pin 108 or the like. Reference numeral 113 designates a ground terminal of an ignition circuit primary wire of the engine, numeral 114 designates a bracket made of an electrical insulator for holding the ground terminal 113, and numeral 115 designates a lead wire and a plug receptacle.

It is to be noted that as shown in FIG. 2, the engagement section 110 connecting the governor spring 109 with the governor lever 103 is constructed so as to have dimensions fulfilling the following relations:

$$B>A>D>d \text{ and } L>l.$$

During normal operation of the engine, as shown in FIGS. 3 to 6, the control lever 105 and the carburetor throttle lever 101 are rotated depending upon a load of the engine and a desired rotational output speed of the engine.

Figure 3:
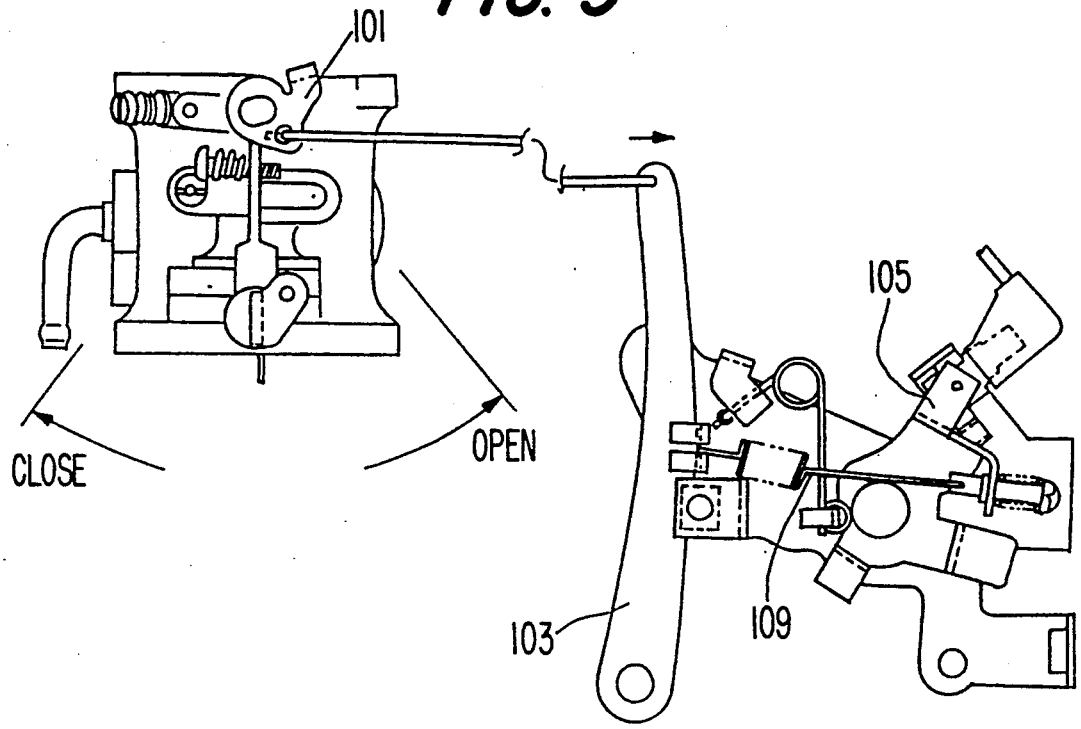
FIG. 3 is a general side view similar to FIG. 1 at the time of a high-speed heavy-load operation.
Figure 4:
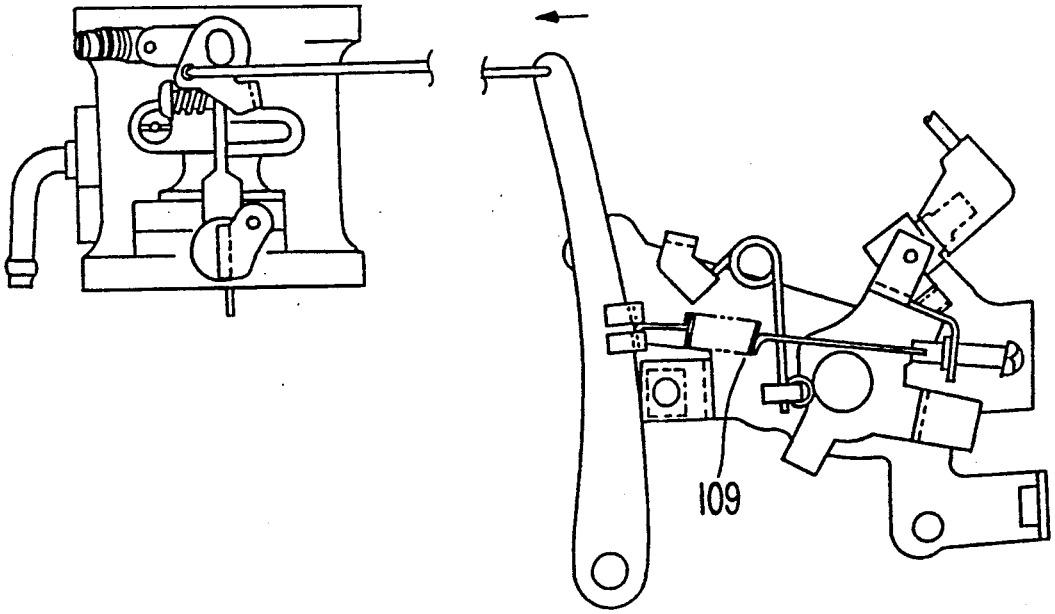
FIG. 4 is a general side view similar to FIG. 1 at the time of a high-speed light-load operation.
Figure 5:
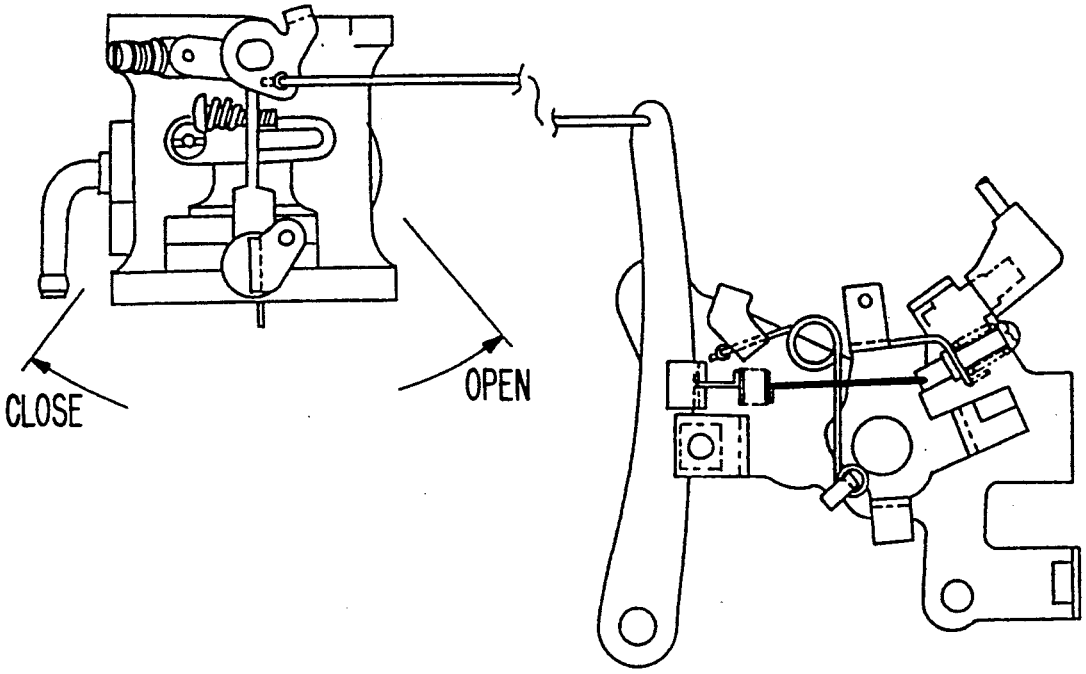
FIG. 5 is a general side view similar to FIG. 1 at the time of a low-speed heavy-load operation.
Figure 6:
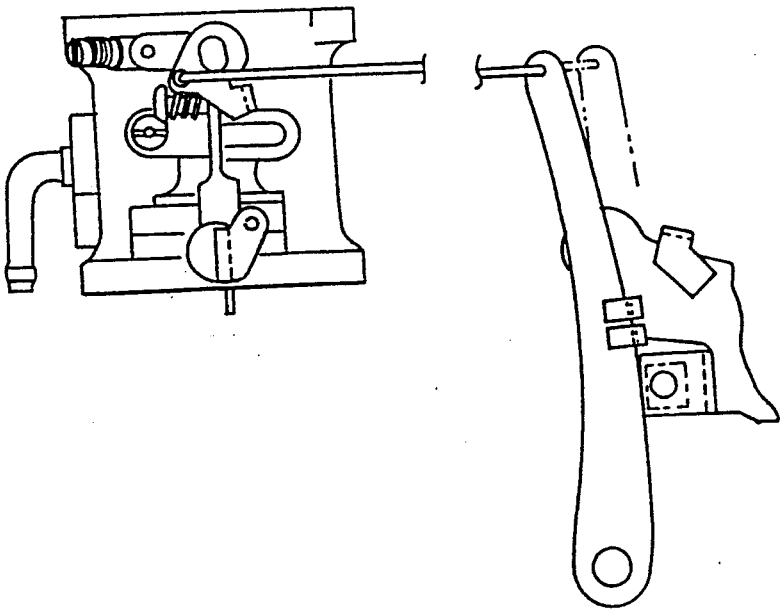
FIG. 6 is a general side view similar to FIG. 1 at the time of a low-speed light-load operation.

More particularly, when the engine is operated at a high speed, the control lever 105 is rotated by the control cable (not shown) in the clockwise direction as viewed in FIGS. 3 to 7, and the carburetor throttle lever 101 is maintained at such position that the tension of the governor spring 109 and the torque exerted in the counterclockwise direction on the governor lever 103 by the governor gear (not shown) balance each other. During a heavy-load operation when the engine requires a lot of fuel, but when only a little fuel is being fed to the engine (when the carburetor throttle valve is more closed than desired), the rotational output speed of the engine is so low that, as shown in FIG. 3, a torque in the clockwise direction is applied to the governor lever 103. As a result, the carburetor throttle lever 101 is moved in a direction which will open the throttle valve. But on the contrary, during a light-load operation (FIG. 4) when the engine does not consume so much fuel, since the carburetor throttle lever 101 is at a position which will close the throttle valve more than compared to the case shown in FIG. 3, the governor spring 109 is in an extended state while the control lever remains in the same position.

Likewise, when the engine is operated at a low speed, the control lever 105 remains at the same position when the position of the carburetor throttle valve 101 is changed depending upon the loading of the engine. As a result, a constant rotational speed is maintained regardless of the loading condition of the engine (see FIGS. 5 and 6).

Figure 7:
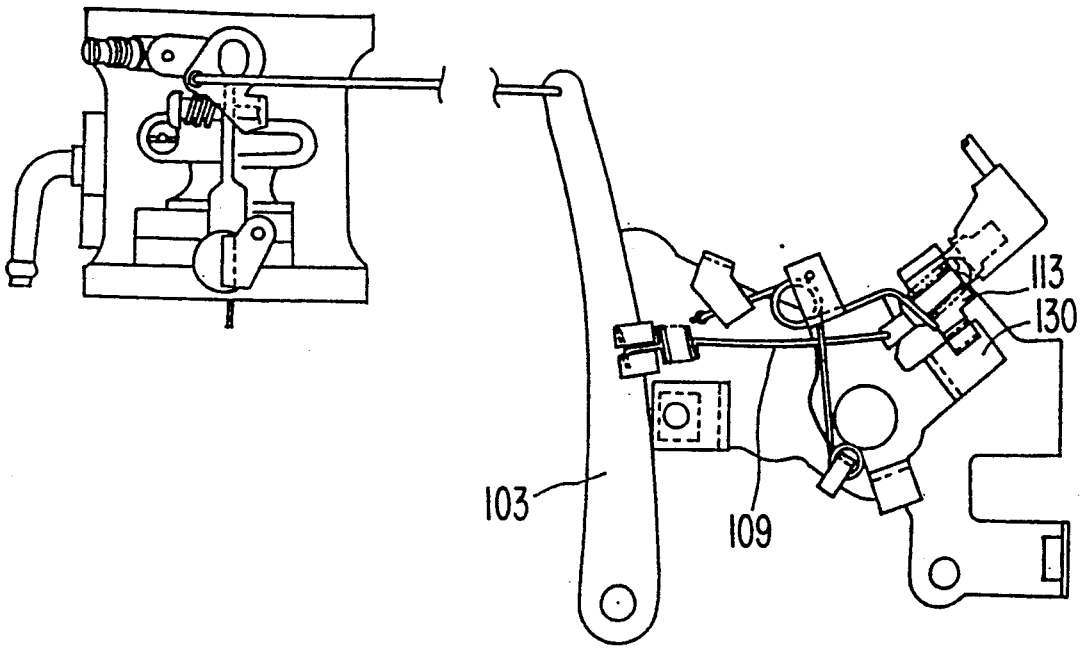
FIG. 7 is a general side view similar to FIG. 1 at the time of stoppage of an engine.
Figure 8:
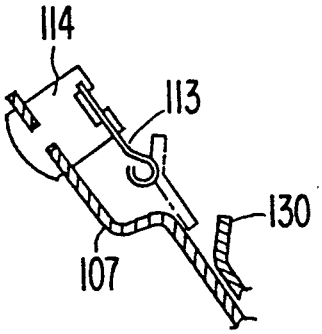
FIG. 8 is a cross-sectional view taken along line Z—Z in FIG. 1.
Figure 9:
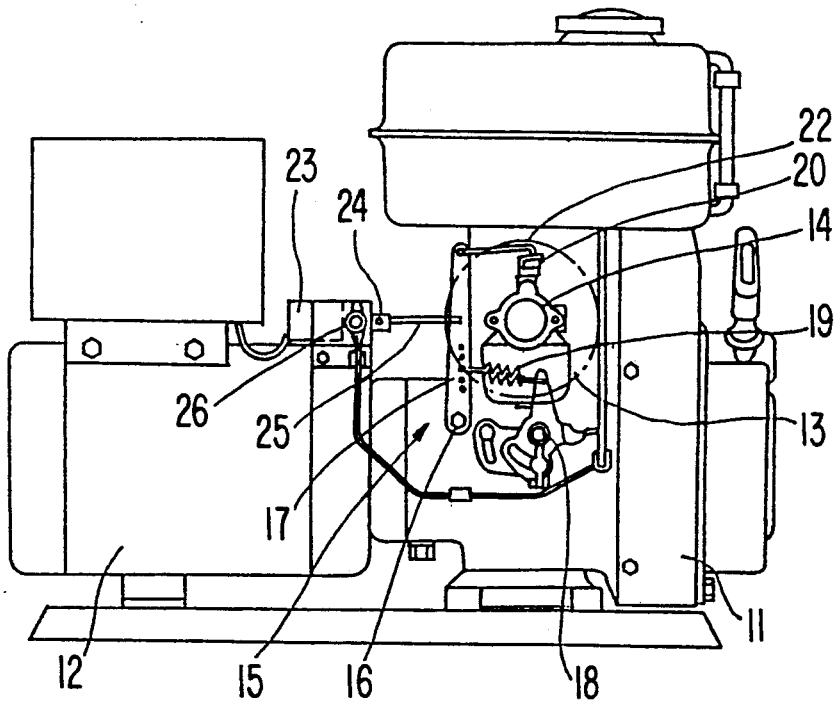
FIG. 9 (PRIOR ART)
FIG. 9 is a front view of an engine directly coupled to a rotary machine in the prior art.
Figure 10:
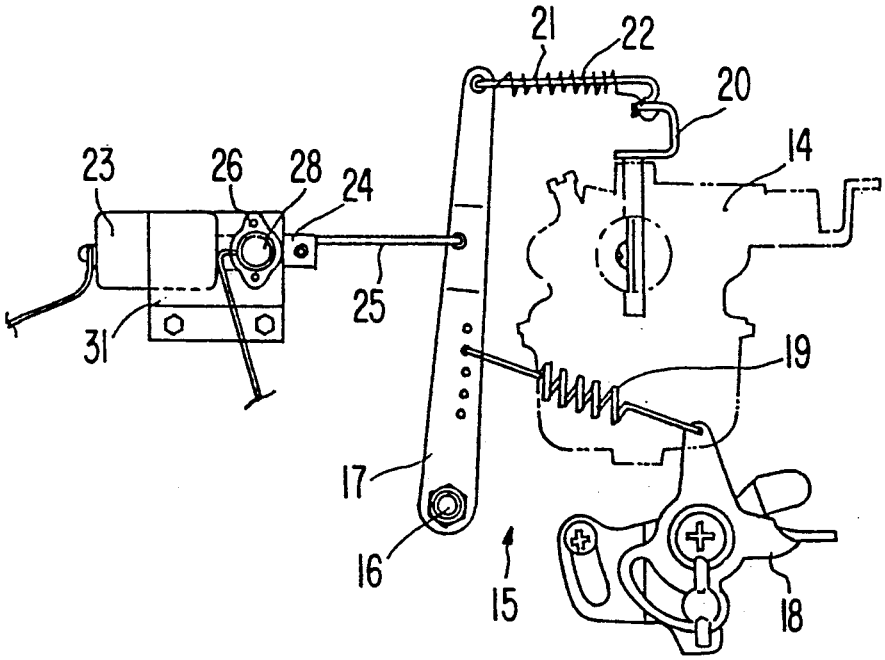
FIG. 10 (PRIOR ART)
FIG. 10 is an enlarged front view of a control apparatus in FIG. 9.
Figure 11:
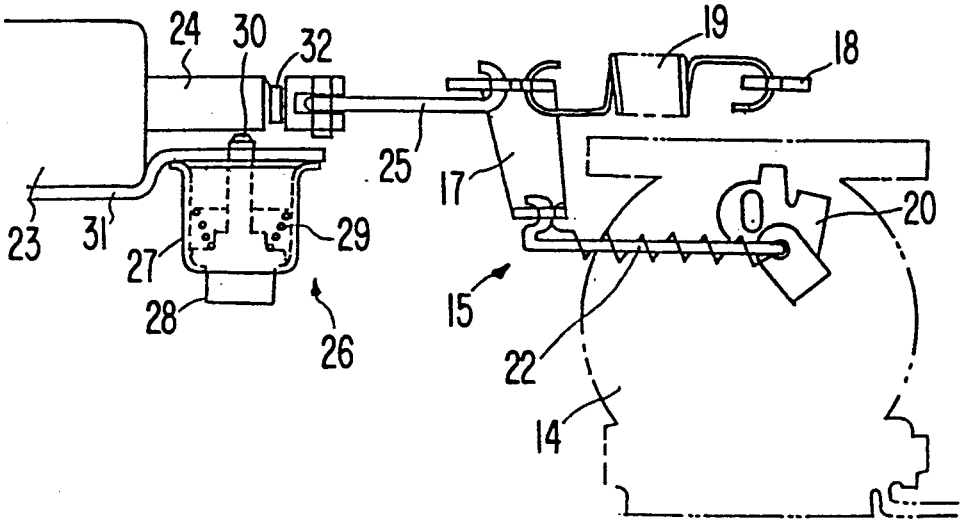
FIG. 11 (PRIOR ART)
FIG. 11 is a plan view of the control apparatus showing the condition wherein a throttle is set to the high-speed side.
Figure 12:
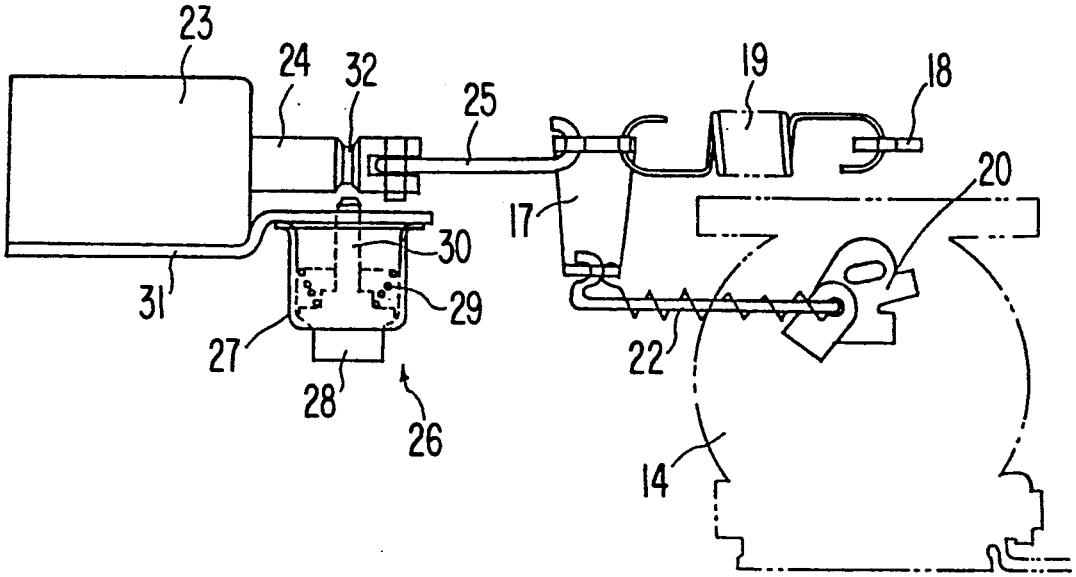
FIG. 12 (PRIOR ART)
FIG. 12 is a plan view of the control apparatus showing the condition wherein a solenoid is excited at the time of a no-load operation and a throttle is held on the low-speed side.
Figure 13:
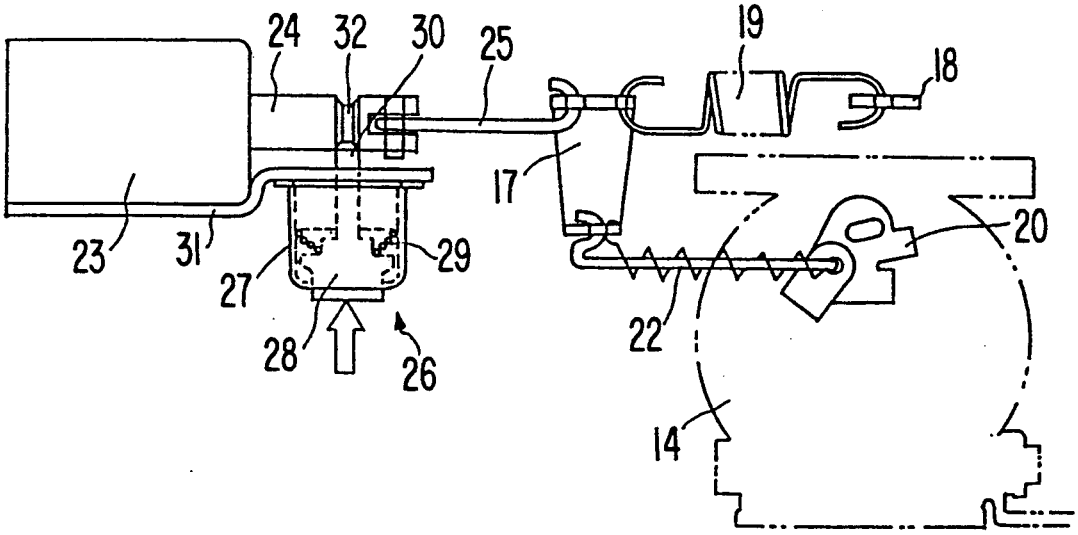
FIG. 13 (PRIOR ART)
FIG. 13 is a plan view of the control apparatus showing the condition wherein a stoppage button has been press-actuated upon stoppage of an engine, wherein a plunger has been retracted, and wherein the throttle has been moved to the low-speed side.

On the other hand, with regard to the operation of the subject system after the engine is stopped, that is, after the grounding of the ignition circuit primary wire, as shown in FIG. 7 and 8, the ground terminal 113 comes into contact with the grounding section 130 provided at one end of the control lever 105. Hence, the generation of sparks by the engine ignition device ceases, and the rotational output speed of the engine gradually decreases. As a result of the decrease in the output of the engine, a torque in the clockwise direction is applied to the governor lever 103 by the governor mechanism. And though this torque acts so as to rotate the throttle lever 101 in the opening direction, since the coiled portion of the governor spring 109 butts against the engagement section 110 of the governor lever 103, the governor lever is restrained from rotating. Consequently, the carburetor throttle lever 101 is maintained at its closed position. Accordingly, in the engine cylinders after the generation of sparks is terminated, the carburetor throttle valve will not open gradually and as such, the unnecessary suctioning of fuel will not occur. Thus, after-burning typically caused by unnecessary fuel will not occur because the fuel itself is not present.

Experiments conducted by the inventors of this invention confirm that the torque of the governor lever resulting from the lowering of the speed of the rotational output of the engine is not so large as to buckle the governor spring 109. And, by selecting the dimensions of the engagement section so as to fulfil the relation of $L>l$, the inconveniences such as the disengagement of the governor spring upon stoppage of the engine would also not arise.

As will be obvious from the detailed description of one preferred embodiment of the present invention above, the following advantages are obtained.

When the engine is stopped, the carburetor throttle valve is maintained at a closed position. Hence, inertial rotation of the engine after the ignition circuit ceases generating sparks will not suction unnecessary fuel into the engine. Consequently, after-burning is prevented without the need for an electrical energy source.

While a principle of the present invention has been described above in connection with one preferred embodiment of the invention, it is intended that all matter contained in the above description and illustrated in the accompanying drawings shall be interpreted to be illustrative and not in a limiting sense.

What is claimed is:

1. In an anti-after-burning system of an internal combustion engine provided with a governor device, in which a governor spring extends between a governor lever and a governor control lever, the governor lever is connected to a carburetor throttle lever, and the carburetor throttle lever controls the opening and closing of a carburetor throttle valve, and a stoppage device for stopping the engine by grounding a primary wire of an ignition circuit, the improvement comprising: a grounding section integral with the governor control lever, said grounding section moveable into contact with the ignition circuit to ground the primary wire of the ignition circuit when the governor control lever is at a rotational stoppage position in the device, connecting means for connecting said governor lever and one end of the governor spring so as to be relatively rotatable and so as to have relative freedom of movement in the axial direction of the governor spring, and said governor spring having a coiled portion so spaced from said connecting means that when said governor control lever is at the stoppage position at which the primary wire of the ignition circuit is grounded through said grounding section, said coiled portion of the governor spring butts against said governor lever to constrain rotation of said governor lever in a direction which would cause the carburetor throttle valve to open.

2. The improvement in an anti-after-burning system of an internal combustion engine as claimed in claim 1, wherein said connecting means for connecting said governor lever with said governor spring has an engagement section defining a slit therein having a width larger than the diameter of the wire of said governor spring, said governor spring extends through said slit, and said governor spring has an end head portion having a larger dimension than the width of said slit, said end head portion being received by said engagement section in a relatively rotatable and freely movable manner.

3. The improvement in an anti-after-burning system of an internal combustion engine as claimed in claim 2, characterized in that the length of said engagement section is greater than the dimension between the end head portion of the governor spring and the coiled portion thereof.

4. The improvement in an anti-after-burning system of an internal combustion engine as claimed in claim 1, and further comprising an engine rotational speed adjusting screw mounted to the governor control level and connected to the other end portion of the governor spring, said screw being movable relative to the governor control lever to adjust the tension exerted by the governor spring thereon.

* * * * *